US006663543B2

(12) United States Patent
Wu

(10) Patent No.: US 6,663,543 B2
(45) Date of Patent: Dec. 16, 2003

(54) COMBINED PULLING AND BENDING CHEST EXERCISER

(75) Inventor: Shui-Chuan Wu, Taichung (TW)

(73) Assignee: Hering Jye Industry Co., Ltd., Taichung (TW)

( * ) Notice: Subject to any disclaimer, the term of this patent is extended or adjusted under 35 U.S.C. 154(b) by 125 days.

(21) Appl. No.: 09/835,639

(22) Filed: Apr. 17, 2001

(65) Prior Publication Data

US 2002/0151418 A1 Oct. 17, 2002

(51) Int. Cl.[7] ..... A63B 21/02

(52) U.S. Cl. ..... 482/126; 482/122; 482/44; 482/127

(58) Field of Search ..... 482/121–133, 482/44, 907, 148, 91

(56) References Cited

U.S. PATENT DOCUMENTS 5,507,712 A * 4/1996 Chang ..... 482/126
5,743,830 A * 4/1998 Ho ..... 482/44
5,868,651 A * 2/1999 Washington ..... 482/91
6,436,017 B1 * 8/2002 Chan ..... 482/121

* cited by examiner

*Primary Examiner*—Jerome W. Donnelly
(74) *Attorney, Agent, or Firm*—Foley & Lardner

(57) ABSTRACT

A chest exerciser includes a hollow seat with top and bottom walls, and left and right side walls interconnecting the top and bottom walls. Each of the side walls has a horizontally extending slide groove which has front and rear groove ends proximate to front and rear ends of the hollow seat, respectively. Each of a pair of lever members includes an inner shaft which has a pivot end extending through the slide groove in a respective side wall and pivoted to the hollow seat about a vertical pivot axis, an outer tube sleeved on the inner shaft and having an abutment end abutting against an outer wall surface of the respective side wall, and a resistance unit for providing resistance to relative axial movement between the inner shaft and the outer tube.

10 Claims, 8 Drawing Sheets

COMBINED PULLING AND BENDING CHEST EXERCISER

BACKGROUND OF THE INVENTION

1. Field of the Invention

The present invention relates to a chest exerciser, more particularly to a chest exerciser which provides combined bending and pulling exercise functions.

2. Description of the Related Art

FIG. 1 illustrates a conventional chest exerciser 1 which includes a pair of handles 101 and a connecting spring 102 interconnecting the handles 101. To exercise a person's arms, the person grips the handles 101 and exerts a force against restoring force of the spring 102, for bending the spring 102 and for moving the handles 101 closer to each other. The spring 102 thus supplies a resisting force to resist the bending action of the exerciser. FIG. 2 illustrates a conventional chest pull 2 which includes a pair of handles 201 and a plurality of extension springs 202 extending between the handles 201. To perform a chest-expanding exercise, a person grips the handles 202 and exerts a pulling force for pulling the handles 202 in opposite directions away from each other, against restoring force of the extension springs 202. The extension springs 202 thus supply a resisting force to resist the pulling action of the exerciser.

However, each of the aforementioned chest exerciser 1 and chest pull 2 can only perform a single exercise mode, i.e., the bending exercise mode or the pulling exercise mode. Moreover, the resisting forces supplied by the springs 102, 202 are not adjustable to suit different persons who require different amounts of exercise.

SUMMARY OF THE INVENTION

Therefore, the main object of the present invention is to provide a combined pulling and bending chest exerciser which provides combined bending and pulling exercise functions.

Accordingly, the chest exerciser of the present invention includes a hollow seat and a pair of lever members. The hollow seat has front and rear ends, top and bottom walls extending between the front and rear ends, and curved left and right side walls interconnecting the top and bottom walls and extending between the front and rear ends. Each of the side walls has a horizontally extending slide groove formed therethrough and extending therealong. The slide groove has a front groove end proximate to the front end of the hollow seat, and a rear groove end proximate to the rear end of the hollow seat. Each of the side walls has an outer wall surface opposite to the other one of the side walls. Each of the lever members includes an inner shaft which has a pivot end extending through the slide groove in a respective one of the side walls of the hollow seat and connected pivotally to the hollow seat for pivoting about a vertical pivot axis transverse to the top and bottom walls, an outer tube sleeved co-axially on the inner shaft and having an abutment end abutting against the outer wall surface of the respective one of the side walls of the hollow seat, and a resistance unit for providing resistance to relative axial movement between the inner shaft and the outer tube. The outer wall surface of each of the side walls of the hollow seat is defined by a curve, wherein points on the curve increase in distance relative to the pivot axis of a respective one of the lever members from the rear groove end to the front groove end. The outer tube of each of the lever members is operable for moving relative to the inner shaft in an axial direction away from the hollow seat against action of the resistance unit. The outer tube of each of the lever members is further operable for moving the inner shaft pivotally about the pivot axis to enable the inner shaft to slide along the slide groove in the respective one of the side walls from the rear groove end toward the front groove end, thereby enabling the outer wall surface of the respective one of the side walls to push the abutment end of the outer tube for moving the outer tube axially relative to the inner shaft against the action of the resistance unit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
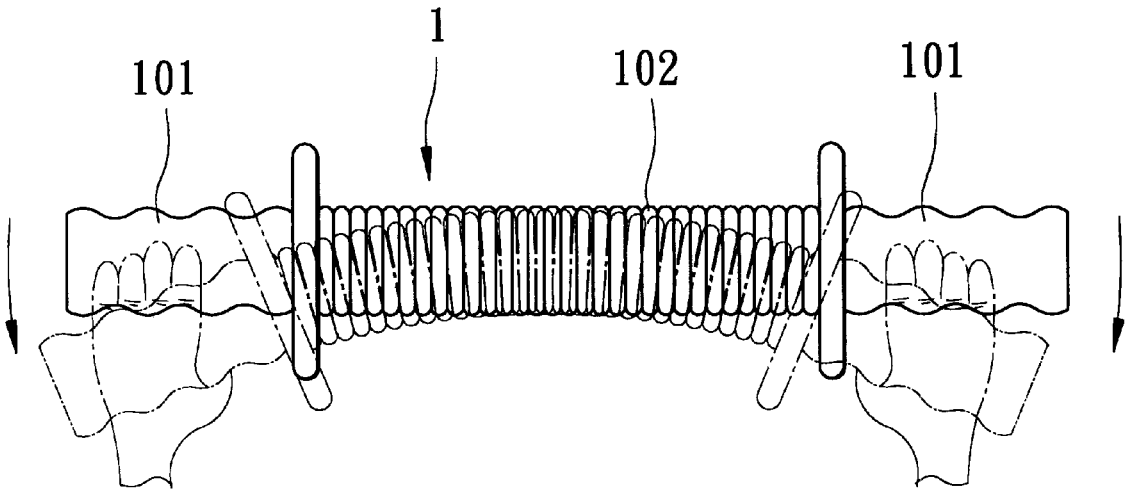
FIG. 1 PRIOR ART
FIG. 1 illustrates a conventional chest exerciser when in use.
Figure 2:
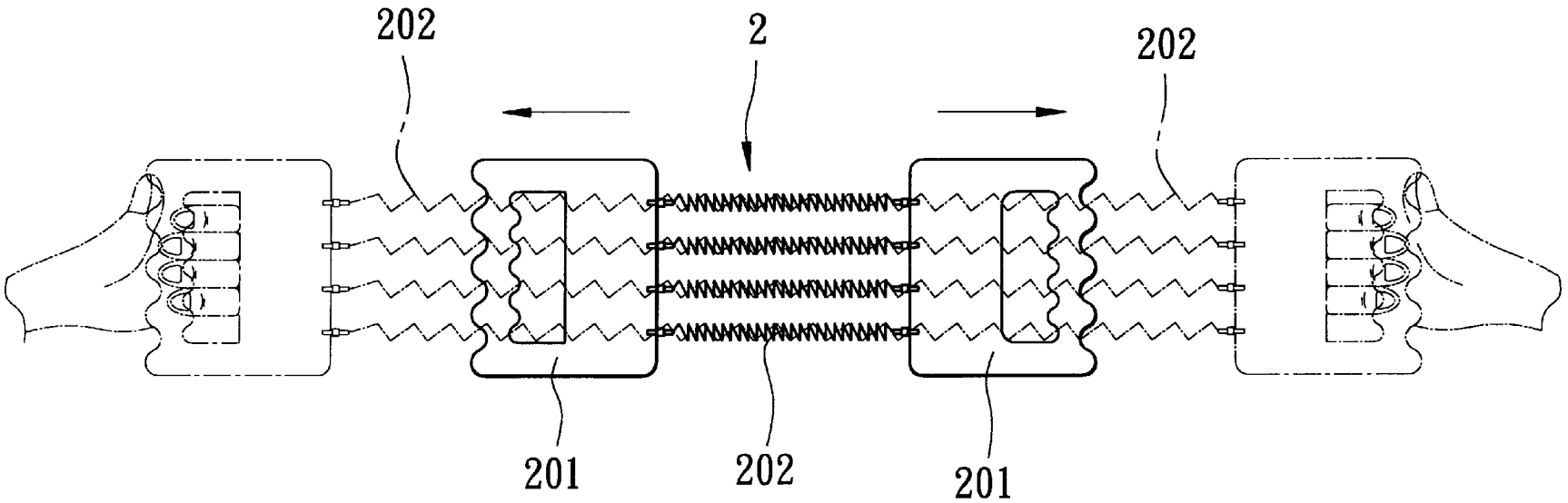
FIG. 2 PRIOR ART
FIG. 2 illustrates a conventional chest pull when in use.
Figure 3:
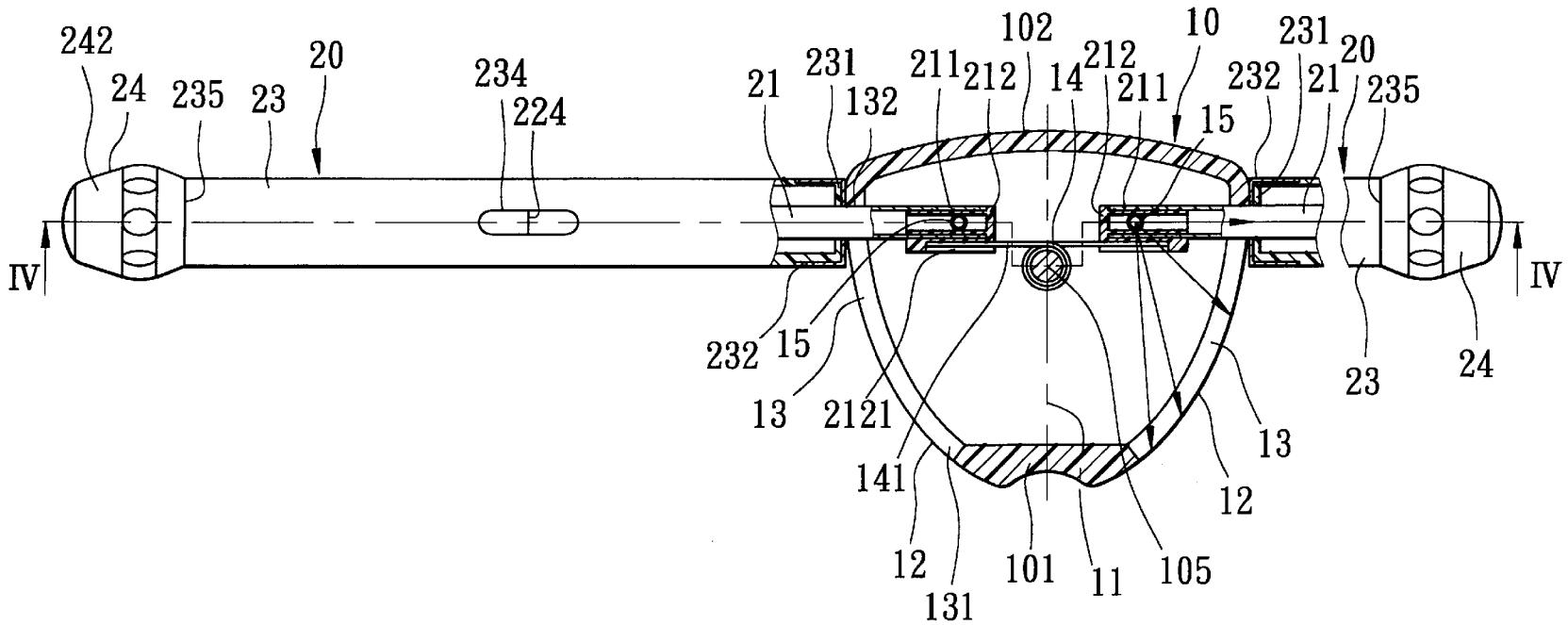
FIG. 3 is a partly-sectioned fragmentary top view of a first preferred embodiment of the chest exerciser of the present invention.
Figure 4:
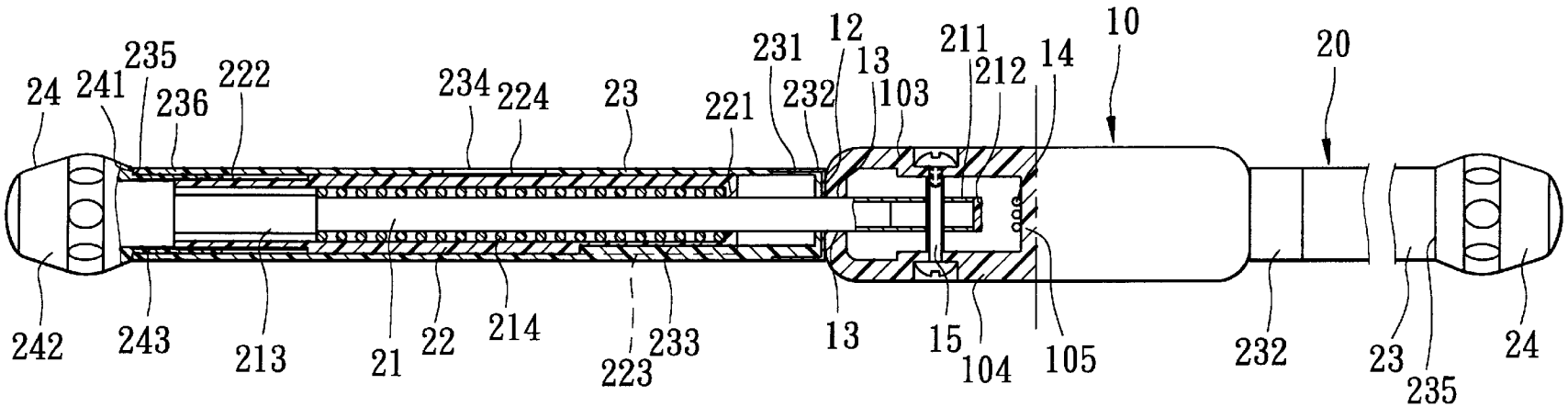
FIG. 4 is a partly-sectioned fragmentary front view of the first preferred embodiment.

Referring to FIGS. 3 and 4, a first preferred embodiment of the combined pulling and bending chest exerciser of the present invention is shown to include a hollow seat 10 and a pair of lever members 20.

The hollow seat 10 has front and rear ends 101, 102, horizontal top and bottom walls 103, 104 extending between the front and rear ends 101, 102, and curved lateral side walls 12 extending between the front and rear ends 101, 102 and interconnecting the top and bottom walls 103, 104. Each of the side walls 12 has a horizontally extending slide groove 13 extending therealong and formed therethrough. The slide groove 13 has a front groove end 131 proximate to the front end 101 of the hollow seat 10, and a rear groove end 132 proximate to the rear end 102 of the hollow seat 10. The hollow seat 10 is symmetric with respect to a vertical plane of symmetry 11 that is transverse to the top and bottom walls 103, 104 and that passes through the front and rear ends 101, 102. The hollow seat 10 further has a vertical post 105 which extends between the top and bottom walls 103, 104 and which is disposed on the plane of symmetry 11. The vertical post 105 has a torsion spring 14 sleeved thereon.

Each of the lever members 20 includes a tubular inner shaft 21, an outer tube 23, and an intermediate tube 22 disposed between the inner shaft 21 and the outer tube 23. The inner shaft 21 has a pivot end 211 which extends through the slide groove 13 in a respective one of the side walls 13 and into the hollow seat 10. The pivot end 211 is provided with an end cap 212 which has an outer surface formed with a spring engaging groove 2121 for engaging a respective one of two opposite legs 141 of the torsion spring 14. The pivot end 211 is pivoted to the hollow seat 10 by means of a vertical pivot pin 15 that is fastened to the top and bottom walls 103, 104 and that extends between the top and bottom walls 103, 104 such that the inner shaft 21 is pivotable relative to the hollow seat 10 about an axis of the pivot pin 15. The inner shaft 21 of each of the lever members 20 slides along the slide groove 13 in the respective one of the side walls 12 when pivoted about the pivot pin 15. In this embodiment, the pivot pins 15 of the lever members 20 are parallel to each other, and are disposed symmetrically with respect to the plane of symmetry 11. Each of the side walls 12 of the hollow seat 10 is defined by a curve, wherein points on the curve increase in distance relative to the axis of the pivot pin 15 of the respective one of the lever members 20 from the rear groove end 132 to the front groove end 131. The inner shaft 21 further has a distal end opposite to the pivot end 211 and formed with an end block 213 with an octagonal cross-section.

The intermediate tube 22 confines an axial hole with an octagonal cross-section so as to be sleeved non-rotatably on the end block 213. The intermediate tube 22 has a first end formed with a radially and inwardly projection annular flange 221, and an externally threaded second end portion 222 sleeved non-rotatably on the end block 213. The intermediate tube 22 has an outer wall surface formed with an axially extending keyway 223. A compression spring 214 is disposed within the intermediate tube 22 and is sleeved on the inner shaft 21. The compression spring 214 has one end abutting against the annular flange 221, and an opposite end abutting against the end block 213 so as to be limited between the annular flange 221 and the end block 213. The outer wall surface of the intermediate tube 22 is further provided with indicia 224 which provide information to indicate the amount of resisting force supplied by the compression spring 214. The outer tube 23 is sleeved on the intermediate tube 22, and has an abutment end 231 which is provided with a metal corner sleeve 232 and which abuts against the outer wall surface of a respective one of the side walls 12 of the hollow seat 10. The corner sleeve 232 is made of copper, and is formed with a hole for extension of the inner shaft 21 therethrough. The outer tube 23 has an inner wall surface formed with an axially extending key projection 233 which engages the keyway 223 in the outer wall surface of the intermediate tube 22 to guide axial movement of the intermediate tube 22 relative to the outer tube 23 and to prevent relative rotation between the intermediate tube 22 and the outer tube 23. The outer tube 23 further has an operating end 236 opposite to the abutment end 231 and provided with an adjustment knob 24 which has a rotary head portion 242 exposed from the outer tube 23, and a tubular section 243 extending from the head portion 242 and into the operating end 236 of the outer tube 23. The head portion 242 has a shoulder 241 abutting against an end face 235 of the operating end 236 of the outer tube 23. The tubular section 243 is internally threaded, and engages threadedly the second end portion 222 of the intermediate tube 22. The outer tube 23 is further formed with a window 234 for inspecting the indicia 224.

Figure 5:
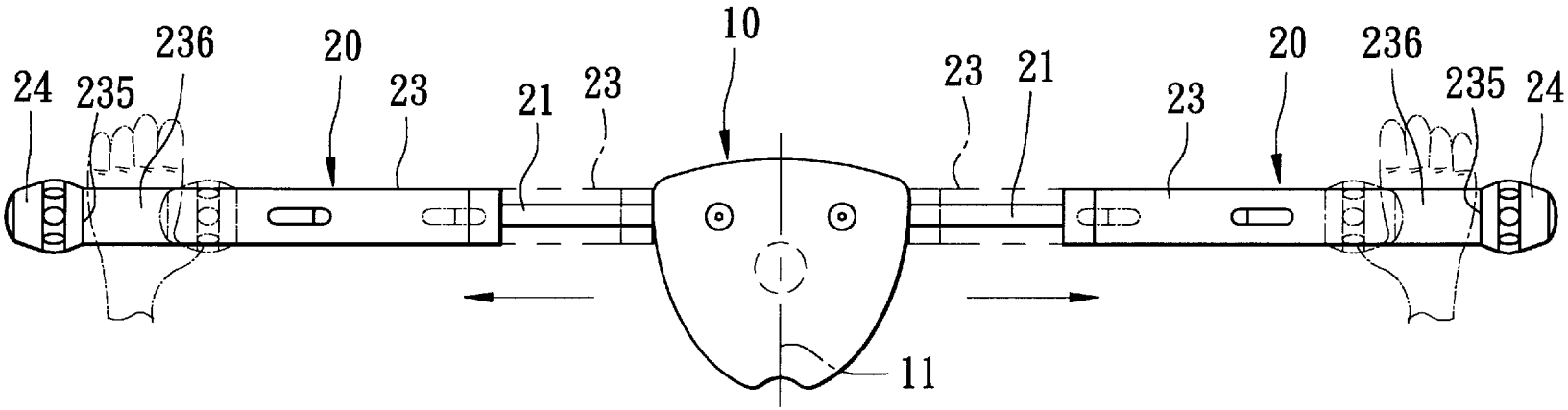
FIG. 5 is a schematic top view of the first preferred embodiment, when operated for performing a pulling exercise mode.

Referring to FIGS. 3 and 5, before the lever members 20 are applied with an external force by the user, the inner shafts 21 are biased by the torsion spring 14 to move toward the rear groove ends 132 such that the lever members 20 are disposed at an angular relationship of 180°. To perform a pulling exercise with the use of the chest exerciser of the present embodiment for expanding the chest of the user, the operating ends 236 of the outer tubes 23 of the lever members 20 are gripped by the hands of the user and are pulled away from each other. Since the end wall 236 on the operating end 235 of the outer tube 23 of each of the lever members 20 abuts against the head portion 242 of the operating knob 24, and since the operating knob 24 engages threadedly the intermediate tube 22, the pulling force is transmitted to the intermediate tube 22 to result in axial movement of the intermediate tube 22 together with the outer tube 23 relative to the inner shaft 21 in a direction away from the hollow seat 10 and the other one of the lever members 20, thereby moving the annular flange 221 closer to the end block 213 of the inner shaft 21 against the restoring force of the compression spring 214. The compression spring 214 in each of the lever members 20 thus supplies a resisting force to resist the pulling action applied by the user.

Figure 6:
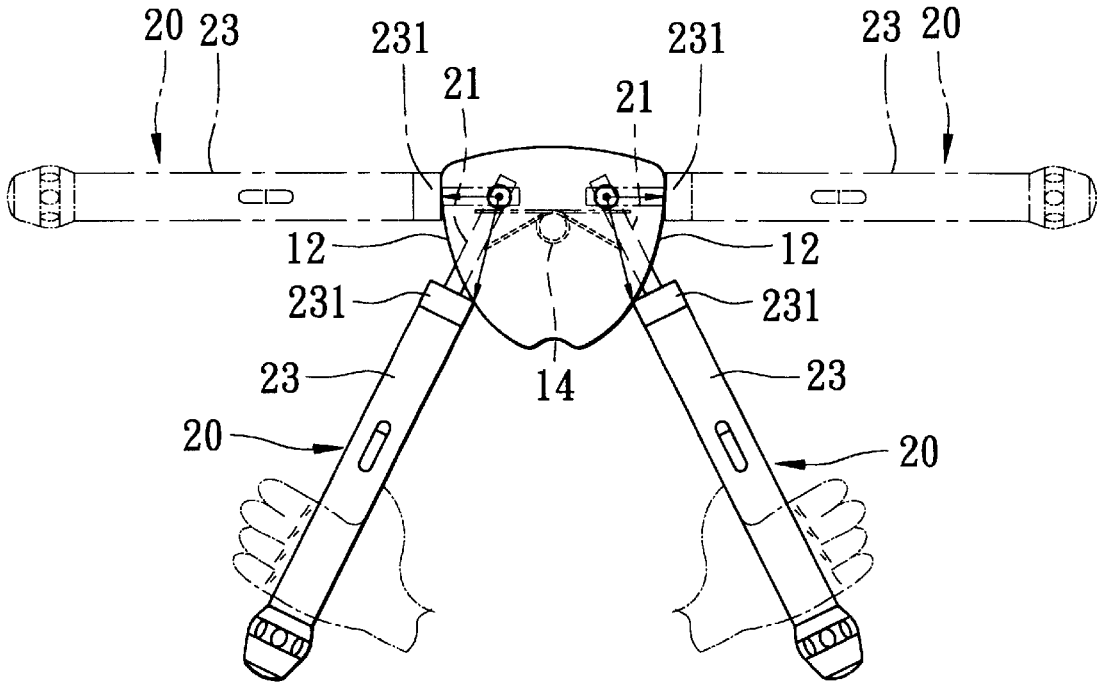
FIG. 6 is another schematic top view of the first preferred embodiment, when operated for performing a bending exercise mode.

Referring to FIGS. 3 and 6, to perform a bending exercise with the use of the chest exerciser of the present embodiment for exercising muscles of a person's arms, the operating ends 236 of the outer tubes 23 are gripped by the person, and the levers 20 are moved pivotally about their respective pivot pins 15 to enable the inner shaft 21 to slide along the slide grooves 13 from the rear groove ends 132 toward the front groove ends 131 against the biasing action of the torsion spring 14, for moving the lever members 20 closer to each other. Since the abutment ends 231 of the outer tubes 23 abut against the outer wall surfaces of the side walls 12, the outer tubes 231 are pushed by the outer wall surfaces of the side walls 12 to move axially relative to the inner shafts 21 and to move farther from their respective pivot pins 15 during pivoting movement of the lever members 20 from the rear groove ends 132 toward the front groove ends 131. The intermediate tubes 22 move with the outer tubes 23 to dispose the annular flanges 221 closer to the end blocks 213 of the inner shafts 21 against the restoring force of the compression springs 214. Likewise, the compression spring 214 in each lever member 20 supplies a resisting force to resist movement of the outer tube 23 along the outer surfaces of the respective side wall 12, thereby resisting the bending action applied by the person.

Figure 7:
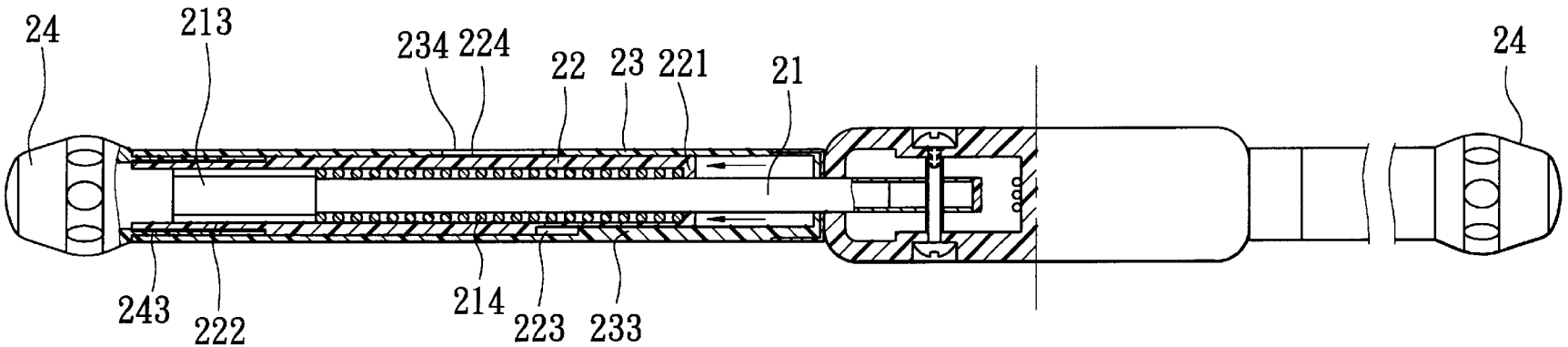
FIG. 7 is another partly-sectioned fragmentary front view of the first preferred embodiment, illustrating how resisting force supplied by a spring is adjusted.

Referring to FIG. 7, to adjust the resisting force supplied by the compression springs 214, the adjustment knobs 24 are rotated to cause linear and axial movement of the intermediate tube 22 relative to the inner shaft 21 and the outer tube 23 so as to move the annular flanges 221 toward or away from the end blocks 213 of the inner shafts 21 to set an initial restoring force of each of the compression springs 214. The initial restoring force is indicated using the indicia 224, which move with the intermediate tube 22 during the adjustment operation and which can be inspected through the window 234.

Figure 8:
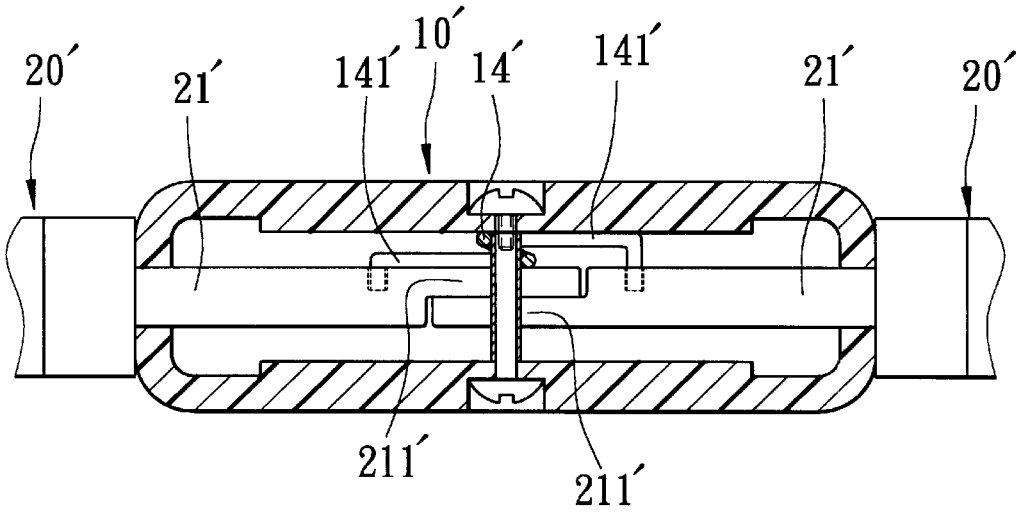
FIG. 8 is a partly-sectioned fragmentary front view of a second preferred embodiment of the present invention.

Referring to FIG. 8, in a second preferred embodiment, the inner shafts 21' of the levers members 20' have pivot ends 211' which are pivoted to the hollow seat 10' at a common pivot pin 15' such that the inner shafts 21' are pivotable relative to the hollow seat 10' about their respective pivot axes, which are co-axial The pivot pin 15' has the torsion spring 14' sleeved thereon and is disposed on the plane of symmetry of the hollow seat 10'. The torsion spring 14' has two legs 141' engaging the pivot ends 211' of the inner shafts 21', respectively. The second preferred embodiment is operated in a manner similar to the previous embodiment. The chest exerciser of the present invention provides the following advantages:

(1) The chest exerciser is operable for performing both pulling exercise mode and bending exercise mode. The compression spring 214 provided in each of the lever members 20 acts to resist both the pulling action and the bending action applied by the user.

(2) By simply operating the adjustment knobs 24, the resisting force supplied by the compression springs 214 can be adjusted to suit different persons who require different amounts of exercise.

In the illustrated embodiments, the compression spring 214 in each of the lever members 20 serves as a resistance unit to resist relative axial movement between the inner shaft 21 and the outer tube 23. However, the resistance unit in the chest exerciser of the present invention should not be limited to the compression springs. Alternatively, a pneumatic resistance unit may be provided between an inner piston shaft and an outer tubular cylinder. The outer tubular cylinder may be formed with air inlet and air outlet valves which are operable to adjust air flow therethrough so as to adjust the resisting force supplied by the pneumatic resistance unit for resisting relative axial movement between the inner piston shaft and the outer tubular cylinder.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A chest exerciser comprising:

a hollow seat having front and rear ends, top and bottom walls extending between said front and rear ends, and curved left and right side walls interconnecting said top and bottom walls and extending between said front and rear ends, each of said side walls having a horizontally extending slide groove formed therethrough and extending therealong, said slide groove having a front groove end proximate to said front end of said hollow seat, and a rear groove end proximate to said rear end of said hollow seat, each of said side walls having an outer wall surface opposite to the other one of said side walls; and a pair of lever members, each of which includes an inner shaft which has a pivot end extending through said slide groove in a respective one of said side walls of said hollow seat and connected pivotally to said hollow seat for pivoting about a vertical pivot axis transverse to said top and bottom walls, an outer tube sleeved co-axially on said inner shaft and having an abutment end abutting against said outer wall surface of the respective one of said side walls of said hollow seat, and a resistance unit for providing resistance to relative axial movement between said inner shaft and said outer tube;

said outer wall surface of each of said side walls of said hollow seat being defined by a curve, points on the curve increasing in distance relative to said pivot axis of a respective one of said lever members from said rear groove end to said front groove end;

said outer tube of each of said lever members being operable for moving relative to said inner shaft in an axial direction away from said hollow seat against action of said resistance unit, said outer tube of each of said lever members being further operable for moving said inner shaft pivotally about said pivot axis to enable said inner shaft to slide along said slide groove in the respective one of said side walls from said rear groove end toward said front groove end, thereby enabling said outer wall surface of the respective one of said side walls to push said abutment end of said outer tube for moving said outer tube axially relative to said inner shaft against the action of said resistance unit.

2. The chest exerciser as claimed in claim 1, further comprising a torsion spring provided in said hollow seat for biasing said inner shafts of said lever members toward said rear groove ends.

3. The chest exerciser as claimed in claim 1, wherein said resistance unit of each of said lever members includes a compression spring sleeved on said inner shaft.

4. The chest exerciser as claimed in claim 3, wherein said inner shaft further has a distal end opposite to said pivot end and formed with an end block with a non-circular cross-section, each of said lever members further including an intermediate tube disposed within said outer tube and around said compression spring, said intermediate tube having a first end portion formed with a radially and inwardly projecting annular flange and a second end portion opposite to said first end portion and sleeved fittingly and non-rotatably on said end block of said inner shaft, said second end portion of said intermediate tube being externally threaded, said compression spring having one end abutting against said annular flange and another end abutting against said end block of said inner shaft, said outer tube of each of said lever members further having an operating end opposite to said abutment end, each of said lever members further including an adjustment knob having an operable head portion exposed from and abutting against said operating end of said outer tube, and an internally threaded tubular section extending from said head portion and into said operating end of said outer tube, said tubular section engaging threadedly said second end portion of said intermediate tube such that axial rotation of said adjustment knob results in axial and linear movement of said intermediate tube relative to said inner shaft, thereby adjusting distance between said end block and said annular flange to adjust restoring force of said compression spring.

5. The chest exerciser as claimed in claim 4, wherein said intermediate tube has an outer wall surface provided with indicia which provide information for indicating the amount of the restoring force of said compression spring, said outer tube being formed with a window for inspecting said indicia.

6. The chest exerciser as claimed in claim 4, wherein said intermediate tube has an outer wall surface formed with an axially extending keyway, said outer tube having an inner wall surface formed with an axially extending key which engages said keyway to guide axial movement of said intermediate tube relative to said outer tube and to prevent relative rotation between said intermediate tube and said outer tube.

7. The chest exerciser as claimed in claim 1, wherein said hollow seat is symmetric with respect to a plane of symmetry which is transverse to said top and bottom walls and which passes through said front and rear ends.

8. The chest exerciser as claimed in claim 7, wherein said pivot axes of said lever members are parallel to each other and are disposed symmetrically with respect to said plane of symmetry.

9. The chest exerciser as claimed in claim 7, wherein said pivot axes of said lever members are co-axial and are disposed on said plane of symmetry.

10. The chest exerciser as claimed in claim 1, wherein said pivot axes of said lever members are co-axial.

* * * * *